US005249341A

United States Patent [19]

Gronau

[11] Patent Number: 5,249,341

[45] Date of Patent: Oct. 5, 1993

[54] WIRE-REMOVING MACHINE

[75] Inventor: Kurt Gronau, Euskirchen, Fed. Rep. of Germany

[73] Assignee: B+G-Fordertechnik GmbH, Fed. Rep. of Germany

[21] Appl. No.: 776,365

[22] PCT Filed: Apr. 19, 1990

[86] PCT No.: PCT/DE90/00292

§ 371 Date: Nov. 26, 1991

§ 102(e) Date: Nov. 26, 1991

[87] PCT Pub. No.: WO90/15756

PCT Pub. Date: Dec. 27, 1990

[30] Foreign Application Priority Data

Jun. 13, 1989 [DE] Fed. Rep. of Germany ..... 3919222

[51] Int. Cl.[5] ..... B65B 69/00

[52] U.S. Cl. ..... 29/33 R; 29/426.4; 29/564.3; 83/909; 242/157 R

[58] Field of Search ..... 140/149, 1; 29/33 R, 29/426.4, 564.3; 83/105, 106, 909; 226/196; 242/157 R, 157.1, 157 C, 76, 7.11, 25 R, 32, 77.1, 140, 172; 72/142, 144

[56] References Cited

U.S. PATENT DOCUMENTS 4,322,041 3/1982 Schuller et al. ..... 242/157 R 4,850,087 7/1989 Gronau ..... 29/33 R

FOREIGN PATENT DOCUMENTS 0281942 3/1988 European Pat. Off. .

*Primary Examiner*—Lowell A. Larson

*Assistant Examiner*—Thomas C. Schoeffler

*Attorney, Agent, or Firm*—Diller, Ramik & Wight

[57] ABSTRACT

A wire-removing machine for bales consist of a positioning device for the bales (1), a cutting device (4) for severing the tying wires tensioned round the bales, a gripper device (5), by means of which the tying wires, after these have been severed, can be lifted off from the bales, and a winding device (6) which grasps all the lifted-off wires in the lifted-off portion by means of a common fork-shaped longitudinally displaceable winding spindle (22) and winds them to form reels. To improve the operation of winding the severed tying wires, there is a row of guide fingers (7) which are arranged in a comb-like manner and which, after the severed tying wires have been lifted off, are arranged in the region between the winding spindle (22) and the bale (1), the tying wires running through between the guide fingers (7) during the winding operation.

9 Claims, 1 Drawing Sheet

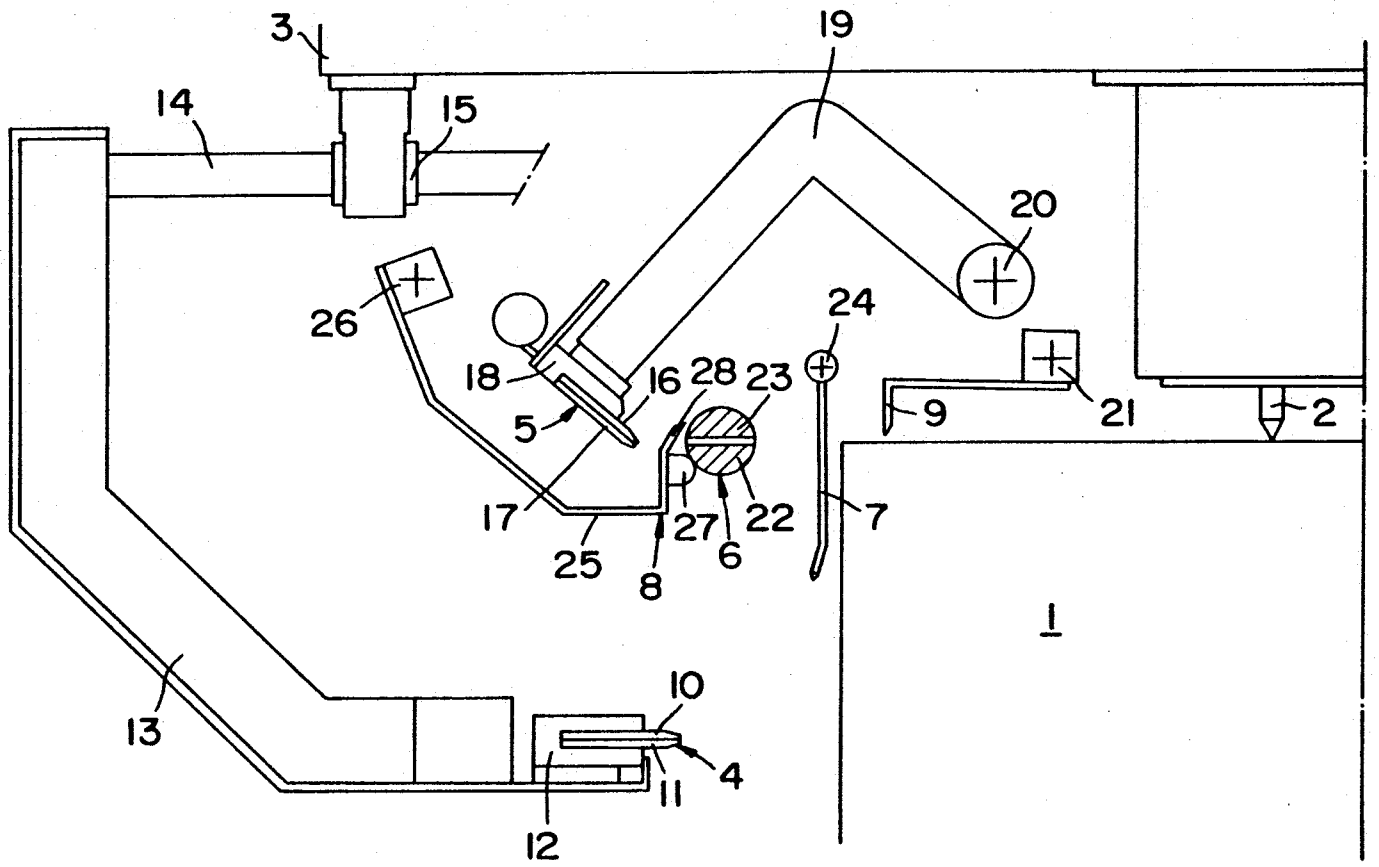
1
2
3
4
5
6
7
8
9
10
11
12
13
14
15
16
17
18
19
20
21
22
23
24
25
26
27
28

WIRE-REMOVING MACHINE

BACKGROUND OF THE INVENTION

The invention relates to a wire-removing machine for bales, especially for pulp bales, consisting of a positioning device for the bales, a cutting device for severing the tying wires tensioned round the bales, in the region of at least one vertical bale side face, a gripper device, by means of which the tying wires, after these have been severed, can be lifted off from the bale, and a winding device which grasps all the lifted-off wires in the lifted-off portion by means of a common fork-shaped longitudinally displaceable winding spindle and winds them to form reels.

A wire-removing machine of the type mentioned is known from German Offenlegungsschrift 3,707,966. With this known apparatus, wires can be removed from bales reliably and automatically.

The object on which the invention is based is, in the known wire-removing machine, to improve the operation of winding the severed tying wires.

SUMMARY OF THE INVENTION

This object is achieved, according to the invention, in that there is a row of guide fingers which are arranged in a comb-like manner and which, after the severed tying wires have been lifted off, are arranged in the region between the winding spindle and the bale, the tying wires running through between the guide fingers during the winding operation.

This measure guarantees that any tying wire to be wound, irrespective of the position which it assumes, is guided reliably and in an oriented manner during the winding operation, so that narrow compact rolls form on the winding spindle. Faults occurring during the winding operation are prevented as a result of the presence of the guide fingers.

Preferably, the guide fingers sit on a common supporting rod, by means of which the guide fingers are maintained in their operating position.

The supporting rod can be arranged with downwardly pointing guide fingers, the lower ends of the guide fingers being located above that position of the gripper device in which lifting strips of the latter come to bear on the bale face for the purpose of grasping the tying wires. When the tying wires are in their lifted-off position and the winding operation is to be initiated, the tying wires are respectively located between two guide fingers, so that the tying wires running onto the winding device are guided reliably. At the same time, the tying wires run through underneath the supporting rod.

Appropriately, the supporting rod is mounted resiliently rotatably together with the guide fingers, so that the row of guide fingers can be displaced out of position in an elastically resilient manner, for example in the event of a collision with the gripper device.

So that the tying wires can be wound up to form compact rolls, there is preferably a press-down device which can be laid against the winding spindle during the winding operation. With a roll increasing in size, the press-down device is lifted off somewhat from the winding spindle.

So that the press-down device can be actuated in a convenient way, it can sit on a pivotably mounted stirrup, by means of which the press-down device can be pivoted into its operating position during the winding operation.

The press-down device can have a continuous strip which is provided, for example, with a rounding on the side facing the winding spindle. During the winding operation, the press-down strip first bears against the surface of the winding spindle and then against the accumulating wire roll.

Alternatively, the press-down device can also be provided with a continuous roller on the side facing the winding spindle.

To guarantee that even the short wire ends run forward reliably in the direction of the winding spindle and cannot lie askew, there are preferably on the press-down device guide pins which are arranged in a comb-like manner and which, during the winding operation, engage into the region between the winding spindle and the gripper device. These guide fingers perform, for the guidance of the short wire ends, approximately the same function as the guide fingers for the long wire ends provided on the opposite side of the winding spindle.

Preferably, after the tying wires have been severed, the gripper device is pivotable upwards with the wire ends to level with the bale top side, so that, when the winding spindle is moving in, the lifted-off tying wires lie approximately in a horizontal plane in extension of the bale top side. In this construction, there can be, at a distance from the upper bale edge facing the winding device, a holding-down strip which extends essentially parallel to this bale edge and which can be lowered onto the bale top side at least while the winding spindle is being moved in. As result of this measure, a specific fixed point for the severed tying wires is formed on the bale top side.

The invention is illustrated by way of example in the drawing and is described in detail below with reference to the drawing.

BRIEF DESCRIPTION OF THE DRAWING

The drawing shows, in a diagrammatic representation, only that region of the wire-removing machine in which the features belonging to the invention can be seen.

DESCRIPTION OF THE PREFERRED EMBODIMENTS

By means of a positioning device not shown in the drawing, a pulp bale 1, of which only an upper corner region can be seen in the drawing, is brought into an exact operating position in relation to the wire-removing machine. With the aid of axially displaceable fixing rams, of which only the ram 2 can be seen in the drawing, the bale 1 is secured in this operating position. The upper fixing rams 2 sit on an upper crossmember 3 which forms the upper region of the machine frame.

The wire-removing mechanism comprises a cutting device 4, a gripper device 5, a winding device 6, a guide device which includes a row of guide fingers 7, a press-down device 8 and a holding-down strip 9.

The cutting device 4 consists of two elongated knife bars 10 and 11 which are equipped on their cutting sides with teeth arranged at regular intervals and which can be pushed to and fro relative to one another. The two knife bars 10 and 11 extend at least over that region of the facing bale side in which tying wires are to be severed.

The two knife bars 10 and 11 sit by means of their mounting 12 on a supporting frame 13 which is itself guided on the upper crossmember 3 so as to be horizontally displaceable towards the bale 1 and away from this. For guidance there are at least two guide rods 14 which are arranged at a distance from one another and which are mounted in bearings 15 on the upper crossmember 3 and can be pushed forwards and backwards with the aid of a drive not shown in the drawing. The drawing shows an inactive position of the cutting device 4, in which the knife bars 10 are at a distance from the bale 1.

The gripper device 5 is arranged at a distance above the knife bars 10 and 11 of the cutting device 4. In a similar way to the cutting device 4, it consists of two lifting strips 16 and 17 which are displaceable relative to one another and which are equipped over their length with stub-type gripping teeth arranged distributed at equal intervals and undercut on the engagement flank, lie parallel to the adjacent bale face and are displacable relative to one another in their longitudinal direction.

The mounting 18 of the lifting strips 16 and 17 sits on a pivoting frame 19 which is pivotable about an axis 20.

While the cutting device 4 is severing the tying wires, the gripper device 5 bears with its lifting strips 16 and 17 against the corresponding bale face at a distance above the knife bars 10 and 11 and grasps the tying wires with its gripping teeth. After the tying wires have been severed, the gripper device 5 pivots into the position shown in the drawing, in which the lifting strips 16 and 17 are approximately level with the bale top side. In this position of the gripper devices, the severed tying wires assume an approximately horizontal position in the region between the bale top side and the gripper device 5. At the same time, the holding-down strip 9, which is pivotable about an axis 21, presses onto the bale top side and fixes the severed tying wires. The holding-down strip 9 extends at a distance from the upper bale edge facing the winding device 6 and is essentially parallel to this bale edge.

While the tying wires are clamped firmly between the gripper device 5 and the holding-down strip 9, the winding device 6 is actuated. This consists of a longitudinally displaceable winding spindle 22 which is made fork-shaped and which receives the tying wires by means of a central transverse slot 23. The outer face of the winding spindle 22 is made approximately cylindrical and serves for the winding of the tying wires.

The guide fingers 7 located between the winding spindle 22 and the bale 1 sit in a comb-like arrangement on a common supporting rod 24, by means of which they are maintained directly in front of the bale edge in a position pointing vertically downwards. During the winding operation, the guide fingers 7 enclose the tying wires between them, so that these are guided in a manner well oriented for winding onto the winding spindle 22. The supporting rod 24 is mounted rotatably about its longitudinal axis and is maintained in its operating position with the aid of an adjustable leaf spring, not shown in the drawing, so that the guide fingers 7 can be deflected elastically out of their position.

After the winding spindle 22, with the transverse slot 23 extending horizontally, has moved into its operating position and has threaded on all the tying wires, the press-down device 8 pivots into its press-down position.

The press-down device 8 consists of a stirrup 25 which is pivotable about a horizontal axis 26. At its free end, the stirrup 25 is equipped with a strip 27 extending at least over the effective length of the winding spindle 23 in which the wires are wound. The strip 27 first bears against the outer face of the winding spindle 22 underneath the initially horizontally arranged transverse slot 23. When, after the winding spindle 22 has been started, the gripper device then opens and the holding-down strip 9 is at least partially released, the tying wires wind on the winding spindle 22 and lift off the strip 27 from the winding spindle 22 under prestress, although the strip 27 always bears on the outside of the forming rolls and ensures that tight firm rolls are produced.

Guide pins 28 pointing obliquely upwards in the direction of the winding spindle 22 and arranged in a comb-like manner extend from the strip 27 and, during the winding operation, project into the region between the winding spindle 22 and the gripper device 5. The guide pins 28 guide the short wire ends coming from the left, so that these cannot lie askew, but are guided in a straight line and can be wound tightly together.

After the severed tying wires have been wound on the winding spindle 22, the press-down device 8 pivots about its axis 26 to the left into its inactive position and the winding spindle 22 moves back and strips off the wound rolls, which fall into a container located underneath the machine.

When wire is to be removed from bales which are held together by means of perpendicularly crossing tying wires, there is a duplicate of the entire apparatus described, specifically one arranged offset at 90° relative to the first, so that all the tying wires of the bale can be removed in a single operation.

I claim:

1. Wire-removing machine for bales comprising a positioning device for the bales, a cutting device for severing vertical tying wires tensioned around the bales, in a region of at least one vertical bale side face, a gripper device by means of which short ends of the tying wires after being severed are lifted from a bale and pivoted upwards about an upper bale edge, a winding device which grasps all lifted-off short ends of tying wires in a lifted-off portion by means of a common fork-shaped longitudinally displaceable winding spindle and winds the wires to form reels, a press-down device for pressing tying wires against the winding spindle, and a guide device for wire ends which consists of a row of guide fingers arranged in a comb-like manner, characterized in that the guide device is an individual unit separate and stationary from the press-down device and is arranged at a distance from the winding spindle directly in front of an upper bale edge, about which short ends of tying wires are pivoted upward by the gripper device, so that, after short ends of severed tying wires have been lifted off and after the winding spindle (22) has been moved into its operating position, the guide fingers (7) are located in a region directly between the winding spindle (22) and an upper edge of the bale (1), and during a winding operation long ends of the typing wires run through and between the guide fingers (7).

2. Wire-removing machine according to claim 1, characterized in that the guide fingers (7) are carried by a common supporting rod (24).

3. Wire-removing machine according to claim 2, characterized in that the supporting rod (24), which extends above an upper bale edge and parallel thereto is equipped with downwardly pointing guide fingers (7), and lower ends of the guide fingers (7) are located above a position of the gripper device (5) in which lifting strips (16, 17) of the gripper device (5) come to bear on a bale face for grasping the tying wires.

4. Wire-removing machine according to claim 2, characterized in that the supporting rod (24) is mounted resiliently rotatable together with the guide fingers.

5. Wire-removing machine according claim 1, wherein the press-down device (8) presses against the winding spindle (22) during the winding operation, and is carried by a pivotably mounted stirrup (25).

6. Wire-removing machine according to claim 5, characterized in that the press-down device (8) has a continuous strip (27) which is provided with a rounded portion on a side facing the winding spindle (22).

7. Wire-removing machine according to claim 5, characterized in that the press-down device (8) is provided with a continuous roller on a side facing the winding spindle (22).

8. Wire-removing machine according to claim 5, characterized in that on the press-down device (8) there are guide pins (28) which are arranged in a comb-like manner which engage into a region between the winding spindle (22) and the gripper device (5) and laterally guide short ends of severed tying wires.

9. Wire-removing machine according to claim 1, characterized in that the gripper device (5) is pivotable upwards such that a part of the gripper device (5) with short wire ends is brought generally level with a bale top side, and at a distance from an upper bale edge facing the winding device (6) is a holding-down strip (9) which extends essentially parallel to an upper bale edge and which is lowered onto a bale top side.

* * * * *